US008448547B2

(12) United States Patent
Whitehead et al.

(10) Patent No.: US 8,448,547 B2
(45) Date of Patent: May 28, 2013

(54) EXTRACTOR TOOL AND EXTRACTOR TOOL KIT

(75) Inventors: Michael L. Whitehead, Clarinda, IA (US); Brian C. Lambert, L'Anse, MI (US)

(73) Assignee: Lisle Corporation, Clarinda, IA (US)

( * ) Notice: Subject to any disclaimer, the term of this patent is extended or adjusted under 35 U.S.C. 154(b) by 376 days.

(21) Appl. No.: 12/762,079

(22) Filed: Apr. 16, 2010

(65) Prior Publication Data

US 2011/0252925 A1 Oct. 20, 2011

(51) Int. Cl.
*B25B 27/18* (2006.01)

(52) U.S. Cl.
USPC ..... 81/53.2; 81/441

(58) Field of Classification Search
USPC ..... 81/53.2, 441, 451, 460; 408/223–225
See application file for complete search history.

(56) References Cited

U.S. PATENT DOCUMENTS

| | | | | |
|---|---|---|---|---|
| 1,746,825 | A * | 2/1930 | Fabel | 81/441 |
| 1,798,944 | A * | 3/1931 | Jackman | 81/53.2 |
| 1,863,045 | A * | 6/1932 | Randall et al. | 81/441 |
| 1,875,484 | A * | 9/1932 | Nigra | 81/441 |
| 4,777,850 | A | 10/1988 | Polonsky | |
| 5,031,487 | A | 7/1991 | Polonsky | |
| 5,251,516 | A | 10/1993 | Desaulniers | |
| 5,438,895 | A * | 8/1995 | Bassell et al. | 81/451 |
| 5,906,146 | A | 5/1999 | Arlen | |
| 6,098,499 | A | 8/2000 | Pool | |
| 6,761,089 | B2 | 7/2004 | Bergamo | |
| 7,152,509 | B2 * | 12/2006 | McCalley et al. | 81/53.2 |
| 2003/0136228 | A1 | 7/2003 | Liu | |

OTHER PUBLICATIONS

Snap-on Extractor, Screw, Spiral Flute—5/32" 7/32" (4mm 6mm) Stock # EX2, Dec. 28, 2009, p. 1 www.buy1.snapon.com/catalog/item.asp?item_ID=10475&group_ID=1261.

Irwin Hanson Spiral Flute Screw Extractors—534/524 Series, Dec. 28, 2009, p. 1-2—www.irwin.com/irwin/consumer/jhtml/detail.jhtml?prodId=IrwinProd100502.

Alden 8440P 4-piece Grabit Broken Bolt and Damaged Screw Extractors Set, Dec. 28, 2009, p. 1-7—www.amazon.com/gp/product/B001A4CWHO/ref=pd_lpo_k2_dp_sr_3?pf_rd_p=4.

Snap-on Extractor, Multi-Spline, 11/32"—Stock #: REX111A, Dec. 28, 2009, p. 1—www.buy1.snapon.com/catalog/item.asp?item_ID=10530&group_ID=1262.

Snap on Extractor, Multi-Spline, 1/4"—Stock #: REX108A, Dec. 28, 2009, p. 1—www.buy1.snapon.com/catalog/item.asp?item_ID=10527&group_ID=1262.

Screw & Bolt Extractors—made in Germany by Elora Werkzeugfabrik, Dec. 28, 2009, p. 1—www.bloomertool.com/ScrewBoltExtractors.html.

(Continued)

*Primary Examiner* — Hadi Shakeri
(74) *Attorney, Agent, or Firm* — Banner & Witcoff, Ltd.

(57) ABSTRACT

An extractor tool for Torx brand and other fluted fasteners comprising an end section for engaging a fastener opening comprising six equally spaced, uniformly sized, pitched flutes separated by uniform depth grooves located at the end of a shank with a cylindrical connecting section joined thereto, in turn, joined to an impact drive end of the shank. The fluted end section has a frusto-conical configuration with the narrow dimension of the fluted end section at the distal end of the tool and wherein the distal end has a flat surface transverse to the longitudinal axis of the shank.

8 Claims, 2 Drawing Sheets

OTHER PUBLICATIONS

Grainger Blackhawk DT-55 Screw Extractor Set, 1/4-5/8 In, 5pc, Dec. 28, 2009, p. 1—www.grainger.com/1/1/86057-blackhawk-dt-55-screw-extractor-set-1-4-5-8-5pc.html.

7 Pc Square Easy Out Set Screw Extractor Desco USA, Dec. 28, 2009, p. 1—www.toolprice.com/c=qkmMrbRb5RiJBPYdefLA8kiM3/product/6912D/7_Pc-Squ . . . .

Jerry's Broken Drill and Tap Removal, Dec. 28, 2009, p. 1-2—www.brokentap.com/easy-outs.html.

Screw Extractor—How to Remove a Broken Screw, Dec. 28, 2009, p. 1-2, www.homerepair.about.com/od/interiorhomerepair/ss/screw_extractor_22.htm.

Idea Disclosure Agreement, Jul. 22, 2008, p. 5.

* cited by examiner

EXTRACTOR TOOL AND EXTRACTOR TOOL KIT

BACKGROUND OF THE INVENTION

In a principal aspect the present invention relates to an extractor tool designed to engage fasteners including Torx brand fasteners, particularly those fasteners which have been damaged in some fashion wherein the flutes of the fastener drive opening do not conform with the standard design requirements for the Torx brand or a similar type fastener.

Fasteners for assembly of various mechanical devices typically include a head with an axial shaft that projects from the head. The shaft may be threaded or otherwise configured to provide an attachment feature. The head is usually configured to have a diameter or shape or configuration which exceeds the size and configuration of the transverse dimension of the shaft. Typically the head of the fastener will include a keyed center opening into which a tool may be inserted to effect a fastening operation. Preferably the opening in the head of the fastener is such that the fastener may not only be inserted or driven into stock material by a tool, but also may be removed by the same tool when desired for replacement, repair or the like.

A problem often observed with fasteners of various design is the degradation of the drive opening associated with the head of the fastener. For example, with respect to a Phillips head fastener, the flutes which are to be engaged by a Phillips type screwdriver may degrade and thereby preclude easy removal of the fastener. The same circumstance may occur with respect to Torx brand fasteners as well as other types of fastener products.

To address this circumstance, various patents describe fastener extraction tools which may be used for extraction of broken or degraded fasteners. Following is a list of patents which disclose such tools and methods for extraction:

| Patent No. | Issue Date | Inventor | Title |
|---|---|---|---|
| 4,777,850 | Oct. 18, 1988 | Polonsky | Drill-Out Threaded Broken Bolt Extractor |
| 5,031,487 | Jul. 16, 1991 | Polonsky | Broken Bolt Extractor |
| 5,251,516 | Oct. 12, 1993 | Desaulniers | Tool for Extracting Broken Bolts and the Like |
| 5,906,146 | May 25, 1999 | Arlen | Apparatus and Method for Extracting Broken Threaded Members |
| 6,098,499 | Aug. 8, 2000 | Pool | Bolt Extraction Tool |
| 6,761,089 | Jul. 13, 2004 | Bergamo | Tool for Removing Screws with Damaged Heads |
| U.S. Publication No. 2003/0136228 A1 | Publication Date Jul. 24, 2003 | Liu | Tool Having a Structure for Removing Damaged Screws |

Various products available in the marketplace designed to effect extraction of fasteners include the following:

Spiral Flute Screw Extractors by Irwin Industrial Tools

Alden 8440P 4-Piece Grabit Broken Bolt and Damaged Screw Extractors Set

Extractor, Multi-Spline, 11/32" and 1/4" by Snap-on

Screw & Bolt Extractors made in Germany by Elora Werkzeugfabrik

Blackhawk DT-55 Screw Extractor Set sold by Grainger

Seven Piece Square Easy Out Set Screw Extractor by Desco USA

Nonetheless difficulties are encountered when attempting to effectively remove various types of fasteners having drive openings that degrade or are otherwise damaged.

SUMMARY OF THE INVENTION

Briefly the present invention comprises a tool as well as a kit of tools which function as an extractor of fasteners particularly Torx brand and other similar types of fasteners wherein the fasteners have degraded and, more particularly, the fastener drive opening in the head of the fastener is degraded or damaged for one reason or another. The extractor tool includes an elongate shank having a center line axis with an impact end and an opposite fastener engaging end. The fastener engaging end is uniquely shaped and compatibly sized for engaging, by way of example, a Torx brand fastener, more particularly, the recess drive opening of such a fastener. The fastener engaging end of the extractor tool thus includes a flat planar distal end surface transverse to the axis of the tool and a nose section extending from that distal, flat end surface. The nose section includes six equally sized and shaped, uniformly pitched flutes. Each of the flutes is separated by equally sized and shaped scalloped grooves. The nose section diverges from the axis of the shank in the range of 10 to 20 degrees from the flat end surface. The flutes are arranged typically in a counterclockwise array, though they may be arrayed in a clockwise sense. The flutes have an outer surface with a radius that is generally transverse to the longitudinal axis of the shank and extend in an arc of about 3 to 10 degrees. The fluted end of the nose section extends to and connects to an intermediate cylindrical section which, in turn, is joined to the impact end of the tool.

A kit of similar tools may be provided wherein the dimensional relationship of each of the tools in the kit is associated with fasteners of a discreet size. Thus the kit may include multiple tools, each of the tools being designed to facilitate extraction of a particular size of fastener.

It is therefore an object of the invention to provide an extractor tool wherein the tool may be impacted at one end to drive a fastener engagement end of the tool into an opening in the head of a fastener to effectively cooperate with flutes and the sides of the opening in the fastener head. In this manner the fastener may be easily engaged and twisted in an appropriate clockwise or counter clockwise direction for removal of the fastener from an assembly or stock material.

A further object of the invention is to provide an inexpensive but highly effective extractor tool.

Another object of the invention is to provide an extractor tool which is easy to manipulate and which is useful with respect to various types of fasteners.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF EMBODIMENTS OF THE INVENTION

Referring to the Figures, it is to be understood that FIGS. 1-5 illustrate a single size of an embodiment of an extractor tool of the invention. Multiple sizes are described based upon the size and features of the fastener which is to be extracted by the tool. Thus, in general, the description of the embodiment of FIGS. 1-5 applies to multiple embodiments wherein a difference or distinction between the embodiments comprises dimensional features and characteristics of the particular extraction tool which, in turn, is associated with a particular fastener that is to be engaged by the tool.

Figure 1:
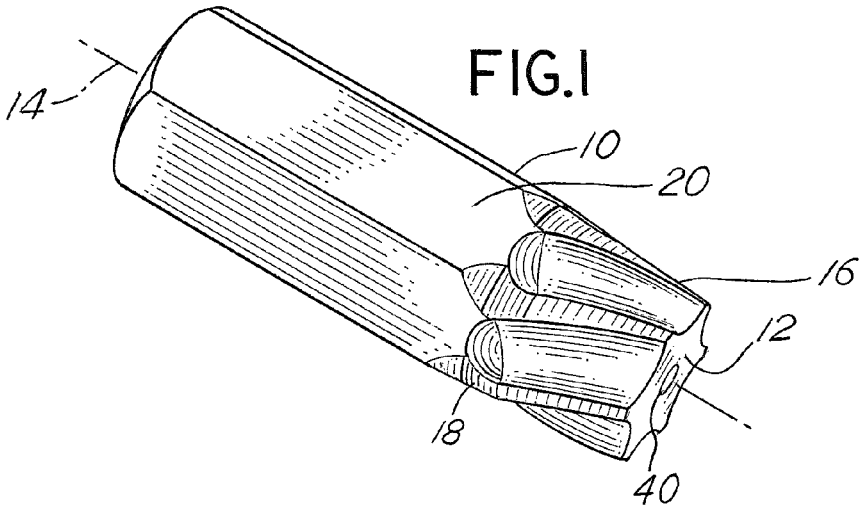
FIG. 1 is an isometric view of a typical extractor tool made in accord with the inventions.
Figure 2:
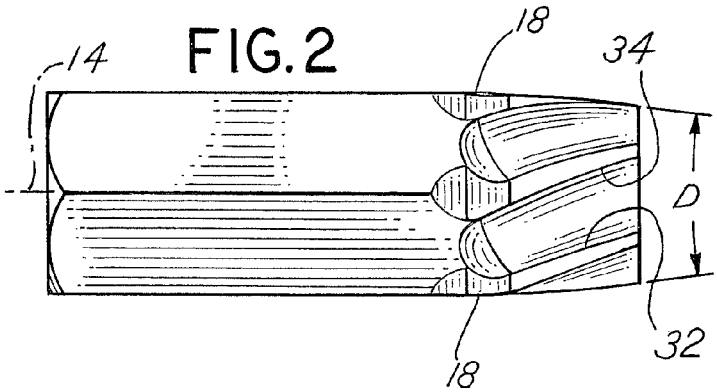
FIG. 2 is a side elevation of the tool of FIG. 1.
Figure 5:
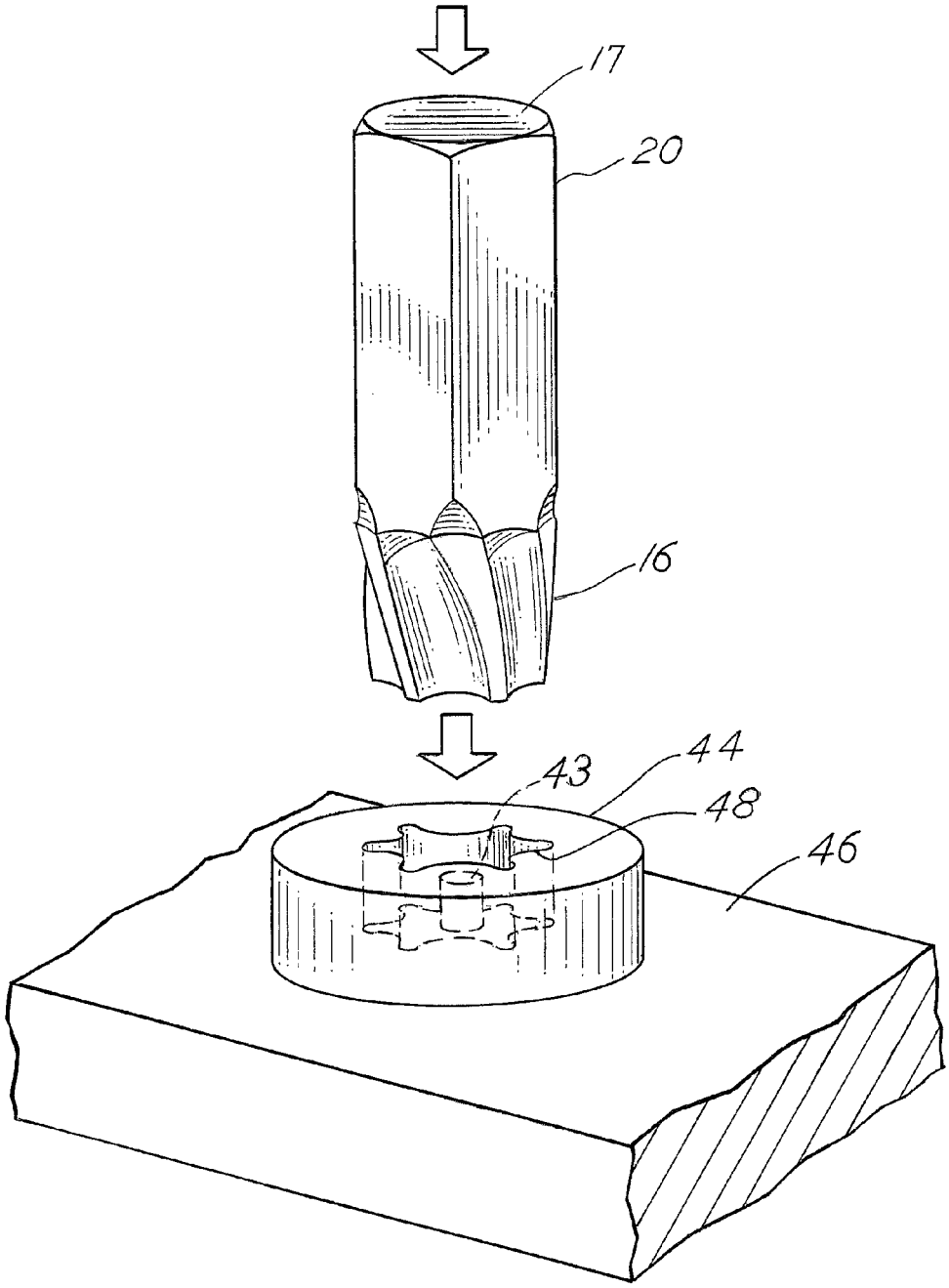
FIG. 5 is an isometric view illustrating the manner of use of the tool of FIGS. 1-4.

Referring to the Figures, the exemplary extractor includes a fluted, generally frusto-conical or rounded frusto-conical forward end 16 having an axis 14 of symmetry and which terminates with a generally transverse distal end surface that is generally a flat planar surface. Thus as shown in FIG. 1, a body or elongate, straight linear shank 10 includes a flat distal end surface 12 which is transverse to longitudinal axis 14. The extractor tool fastener engaging end 16, which is generally frusto-conical in configuration and connects with or is integrally joined onto a generally cylindrical section 18 that, in turn, is joined to an impact section or end 20 of the tool. The impact end 20 has a hexagonal cross section or drive configuration and an end drive face 17 for receipt of an impact. The fastener engaging end 16 is configured in a manner which renders it at least partially compatible with an opening in a fastener such as a Torx brand fastener. The tool is designed to be impacted at its impact end 20 on face 17 so that the fastener engaging end 16 can be driven into a compatibly sized drive opening in the head of a fastener as shown in FIG. 5.

Figure 3:
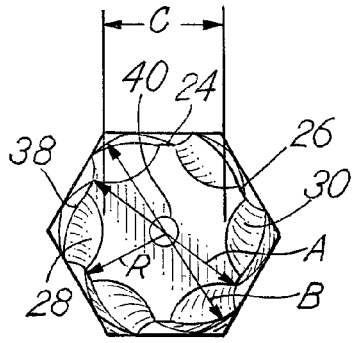
FIG. 3 is an end elevation of the tool of FIG. 2 as viewed from the fastener engaging end.

The fastener engaging end 16 includes a series of six generally equally sized and generally identically shaped flutes such as flute 24 and flute 26. The six flutes are distributed uniformly, radially about the centerline axis 14. Each pair of the flutes is separated by equally sized, equal depth and equally shaped scalloped grooves such as grooves 28 and 30. Thus each groove intersects a pair of adjacent flutes along first and second generally parallel uniformly spaced edges such as edges 32 and 34 in FIG. 2. The flutes 26, 28 have an arcuate outer surface 38 such as illustrated in FIG. 3. The outer surface 38 has a radius of curvature equal for each flute. Surface 38 generally lies on an arc of a circle in the range of about 3 to 10 degrees. In other words, the surface 38 has an arc ranging between about 3 to 10 degrees with respect to a radius of the curvature of surface 38 which is generally transverse to the axis 14. A radius R defined on the end surface 12 is equal in length for each flute (e.g. 24, 26). Also each radius R for each flute (e.g. 24, 26) is equally spaced. Further the fastener engaging end 16 diverges and maintains a generally frusto-conical configuration that diverges outwardly from a tangent to the end surface 12 relative to the longitudinal axis 14 in the range of 10 to 20 degrees.

The flutes 24 and 26 have a pitch which is typically in the range of 20 to 40 degrees in the clockwise direction or counterclockwise direction. The grooves, such as groove 28 between the adjacent flutes 24 and 26, are generally uniform and have a uniform depth along the longitudinal dimension. Of course the grooves and the flutes all merge into the generally cylindrical midsection 18. Attached as Table 1 is a summary of the angular limitations and dimensions of multiple extractor tools of the type described wherein the dimensions set forth are keyed to the size of a Torx brand fastener with the dimensions A through E identified or specified in FIGS. 1-4 and Feature F comprising the pitch of the flutes.

TABLE 1

| Tool | No. 1 | No. 2 | No. 3 | No. 4 | No. 5 | No. 6 | No. 7 | No. 8 | No. 9 | No. 10 |
|---|---|---|---|---|---|---|---|---|---|---|
| A | .107 | .128 | .154 | .180 | .198 | .212 | .256 | .303 | .356 | .428 |
| B | .138 | .159 | .200 | .228 | .246 | .284 | .328 | .374 | .428 | .518 |
| C | .078 | .090 | .100 | .115 | .140 | .146 | .194 | .224 | .248 | .314 |
| D | 14° Nose Angle | 14° Nose Angle | 14° Nose Angle | 14° Nose Angle | 14° Nose Angle | 14° Nose Angle | 14° Nose Angle | 14° Nose Angle | 14° Nose Angle | 14° Nose Angle |
| E | Ø1/16 Flute | Ø1/16 Flute | Ø3/32 Flute | Ø7/32 Flute | Ø1/8 Flute | Ø1/8 Flute | Ø1/8 Flute | Ø5/32 Flute | Ø7/32 Flute | Ø7/32 Flute |
| F | 20° Rotation | 20° Rotation | 30° Rotation | 30° Rotation | 30° Rotation | 30° Rotation | 30° Rotation | 30° Rotation | 30° Rotation | 30° Rotation |
| Fits Torx Brand Fastener | T-10 | T-15 | T-20 | T-25 | T-27 | T-30 | T-40 | T-45 | T-47/50 | T-55 |

Dimension Descriptions

A. Diameter dimension between opposite flute edges (32, 34)

B. Diameter dimension of cylindrical section (18)

C. Minimum distance between opposite grooves (28, 30)

D. Angle of divergence of tangents to forward frusto-conical end at the end surface (12)

E. Dimension of width of flutes (e.g. 26, 28) between edges (e.g. 32, 34)

F. Pitch of flutes (Dimensions are in inches)

Figure 4:
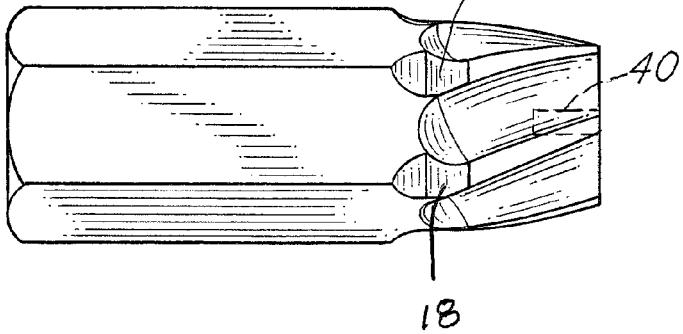
FIG. 4 is a top plan view of the tool of FIG. 2.

As an additional feature of the invention, an axial counterbore opening 40 may be provided extending inwardly from the flat planar distal end surface 12. FIG. 4 illustrates, in phantom, opening 40. The counterbore opening 40 provides clearance for an axial protrusion 43 incorporated in a drive opening in the head end 48 of a fastener 44 which renders the fastener 44 "tamper proof". Also counterbore or opening 40 functions to provide for receipt and storage of shards or other materials that might be within the drive opening of the head or head end 48 of a fastener 44 that is to be extracted using the tool. The axial passage 40 which is depicted in FIG. 4 is generally a cylindrical counterbore although other configurations may be adopted.

FIG. 5 depicts the manner of use of the tool. Typically the tool is aligned axially with the generally hexagonal opening 48 of a fastener 44 (e.g. a Torx fastener) in a stock piece 46. The fastener engaging end 16 is slightly smaller at the location end surface 12 and may be driven into the opening 48 in the fastener 44 by impacting the impact surface 17 of the extractor tool. Upon appropriate engagement of the tool into the opening 48, the extractor tool impact end 20, which is hexagonal and otherwise has a keyed configuration, may be rotated to remove the fastener 44 from the stock material 46. Typically, because the flutes 26 and 28 are counterclockwise, rotation of the tool body 10 may be effected to remove right hand threads. Clockwise flutes may be provided in separate tools for removal of left hand thread fasteners.

While there has been set forth a preferred embodiment of the invention, it is to be understood that the invention is to be limited only by the following claims and equivalents.

What is claimed is:

1. An extractor tool for effecting removal of Torx brand and fluted drive opening fasteners comprising:

an elongate shank having a longitudinal centerline axis, a peripheral surface, an impact end section and a fastener engaging end section;

said fastener engaging end section compatibly sized for engaging a Torx brand fastener opening, said fastener engaging end section having a configuration characterized by a generally flat, planar, distal end surface transverse to the shank centerline axis, a nose section extending axially toward the impact end section from the distal end surface, said nose section including six equally sized and shaped, uniformly pitched flutes, each flute having a first edge and a generally parallel second edge, each pair of flutes separated by an equally sized and shaped scalloped groove extending through and into the peripheral surface, each of said grooves intersecting a pair of adjacent flutes along said first and second generally parallel, uniformly spaced edges of said adjacent flutes, said nose section including a first portion immediately adjoining the distal end surface and extending axially therefrom toward the impact end section and a second, generally co-axial cylindrical portion extending from and adjoining the first portion and intermediate the first portion and the impact end section;

each of said first portion flutes of said nose section having an arcuate outer surface defining a smooth arc with a radius of curvature centered on the longitudinal axis, said arc extending about 3° to 10° and said fastener engaging end having a generally frusto-conical configuration diverging from the longitudinal axis outwardly from fastener engaging end to a tangent from the end surface relative to the longitudinal axis in the range of about 10° to 20° ;

all of said flutes having an equal pitch in the range about 20° to 40° in either a clockwise or counter clockwise direction, all of said grooves including a generally uniform and equal depth.

2. A set of the tools of claim i in the form of a kit generally in accord with the following table for use with the correlated fastener:

| Tool | No. 1 | No. 2 | No. 3 | No. 4 | No. 5 | No. 6 | No. 7 | No. 8 | No. 9 | No. 10 |
|---|---|---|---|---|---|---|---|---|---|---|
| A | .107 | .128 | .154 | .180 | .198 | .212 | .256 | .303 | .356 | .428 |
| B | .138 | .159 | .200 | .228 | .246 | .284 | .328 | .374 | .428 | .518 |
| C | .078 | .090 | .100 | .115 | .140 | .146 | .194 | .224 | .248 | .314 |
| D | 14° Nose Angle | 14° Nose Angle | 14° Nose Angle | 14° Nose Angle | 14° Nose Angle | 14° Nose Angle | 14° Nose Angle | 14° Nose Angle | 14° Nose Angle | 14° Nose Angle |
| E | Ø1/16 Flute | Ø1/16 Flute | Ø3/32 Flute | Ø7/32 Flute | Ø1/8 Flute | Ø1/8 Flute | Ø1/8 Flute | Ø5/32 Flute | Ø7/32 Flute | Ø7/32 Flute |
| F | 20° Rotation | 20° Rotation | 30° Rotation | 30° Rotation | 30° Rotation | 30° Rotation | 30° Rotation | 30° Rotation | 30° Rotation | 30° Rotation |

where A is the diameter dimension between opposite flute edges (32, 34);

where B is the diameter dimension of cylindrical section (18);

where C is the minimum distance between opposite grooves (28, 30), where D is the angle of divergence of tangents to forward frusto-conical end at the end surface (12);

where E is the dimension of width of flutes (e.g. 26, 24) between edges (32, 34);

where F is the pitch of flutes.

3. The tool of claim 1 wherein the impact end section comprises a drive.

4. The tool of claim 1 wherein the flutes and grooves are directed generally 30° counter clockwise.

5. The tool of claim 1 wherein the angle of divergence of the tangents to the first portion are about 14°±2°.

6. The tool of claim 1 wherein the flutes and grooves are directed generally 30° counter clockwise; and the angle of divergence of the tangents to the first portion are about 14°±2°.

7. The tool of claim 1 further including a passage in the first portion extending axially from the end surface toward the impact end section.

8. The tool of claim 7 wherein the passage is a cylindrical counterbore.

* * * * *